US008317031B2

(12) United States Patent
Zeller

(10) Patent No.: US 8,317,031 B2
(45) **Date of Patent: *Nov. 27, 2012**

(54) METHOD AND APPARATUS FOR SEPARATING FINE PARTICULATE MATTER FROM OTHER MATERIALS

(75) Inventor: Bruce K. Zeller, Cave Creek, AZ (US)

(73) Assignee: Z Screen LLC, Phoenix, AZ (US)

( * ) Notice: Subject to any disclaimer, the term of this patent is extended or adjusted under 35 U.S.C. 154(b) by 1249 days.

This patent is subject to a terminal disclaimer.

(21) Appl. No.: 11/854,230

(22) Filed: Sep. 12, 2007

(65) Prior Publication Data

US 2008/0023376 A1 Jan. 31, 2008

Related U.S. Application Data

(63) Continuation of application No. 10/779,448, filed on Feb. 12, 2004, now Pat. No. 7,306,104.

(60) Provisional application No. 60/447,222, filed on Feb. 12, 2003.

(51) Int. Cl.
*B07B 1/28* (2006.01)

(52) U.S. Cl. ..... 209/413; 209/412; 209/420; 280/490.1

(58) Field of Classification Search ..... 209/420, 209/421, 412, 413, 260; 171/139, 141, 143; 280/490.1, 491.1, 491.4; 296/183.2
See application file for complete search history.

(56) References Cited

U.S. PATENT DOCUMENTS

| | | | | | |
|---|---|---|---|---|---|
| 399,486 | A | * | 3/1889 | Bradshaw | 209/345 |
| 590,571 | A | * | 9/1897 | Hartman | 209/420 |
| 1,011,889 | A | | 12/1911 | Myer | |
| 1,730,260 | A | * | 10/1929 | Zuckerman | 383/95 |
| 1,783,189 | A | * | 12/1930 | Green | 280/490.1 |
| 3,162,600 | A | | 12/1964 | Montgomery | |
| 3,232,426 | A | * | 2/1966 | Caparrella et al. | 209/44 |
| 3,307,698 | A | * | 3/1967 | Haffner | 209/258 |
| 3,362,480 | A | * | 1/1968 | Barber | 171/89 |
| 4,147,256 | A | | 4/1979 | Kiss | |
| 5,084,991 | A | * | 2/1992 | Cronk, Jr. | 37/142.5 |
| 5,335,784 | A | * | 8/1994 | Tyler | 209/260 |
| 5,361,911 | A | | 11/1994 | Waites et al. | |
| 5,454,620 | A | * | 10/1995 | Hill et al. | 296/183.2 |
| 5,482,165 | A | * | 1/1996 | Johnston | 209/244 |
| 5,855,352 | A | | 1/1999 | Bellamy et al. | |
| 5,927,513 | A | * | 7/1999 | Hart | 209/677 |
| 6,019,227 | A | | 2/2000 | May, III | |

FOREIGN PATENT DOCUMENTS

| | | | |
|---|---|---|---|
| BE | 720 085 | A | 2/1969 |
| DE | 37 12 373 | A1 | 11/1988 |
| FR | 2 567 776 | A | 1/1986 |
| WO | 96/04060 | A | 2/1996 |

* cited by examiner

*Primary Examiner* — Joseph C Rodriguez
(74) *Attorney, Agent, or Firm* — Zeman-Mullen & Ford, LLP

(57) ABSTRACT

A method and apparatus for separating fine particulate matter from debris and bulk material is presented which includes a frame, a screen connected to the frame that is adjustable in height relative to the frame at one of its ends, a removable trough positioned near the back end of the frame, and a motor for vibrating the frame to assist in separation of materials.

9 Claims, 6 Drawing Sheets

METHOD AND APPARATUS FOR SEPARATING FINE PARTICULATE MATTER FROM OTHER MATERIALS

CROSS REFERENCE TO RELATED APPLICATIONS

This application is a continuation of and claims benefit of priority to U.S. Nonprovisional patent application Ser. No. 10/779,448 filed Feb. 12, 2004, currently pending, which claims the benefit and priority of U.S. provisional patent application having Ser. No. 60/447,222, filed Feb. 12, 2003, both of which are herein incorporated by reference.

FIELD OF INVENTION

The present invention generally relates to a method and apparatus for separating a fine particulate matter from other materials and, more particularly relates to a method and apparatus for separating a fine particulate material, such as sand, from other materials which utilizes a portable apparatus having an adjustable screen connected to a frame which can be positioned at various angles with respect to the frame. Although particularly suited for use in sand traps on golf courses for the separation of sand from other materials such as rocks, grass, clippings, clay and twigs, the method and apparatus of the present invention may also be used to separate a variety of other fine particulate materials that can pass through the adjustable screen.

BACKGROUND OF THE INVENTION

Apparatus for separating one type of material from another are well known in the art. However, certain locations and situations present circumstances where an efficient, cost effective, and moveable apparatus for separating materials would prove to be beneficial. For example, golf courses are maintained to ensure that they are aesthetically pleasing to paying customers. In order aesthetically maintain gold courses, sand traps must be cleaned and cleared of debris which requires workers to sift through the sand to remove trash and debris, as well as large rocks and other obstacles. In that there are numerous sand traps on any given golf course, an efficient and transportable separation apparatus would allow workers to aesthetically maintain the sand traps in a quick and efficient manner.

Accordingly, there is a need for a compact, moveable separation apparatus that can quickly and efficiently separate materials from one another on site.

SUMMARY OF THE INVENTION

The present invention is directed to an apparatus for separating a fine particulate material from other matter and generally includes a support frame having a front end and a back end, an adjustable screen having a front end, a back end, a top surface and a bottom surface where the screen is positioned over a top of the frame and the back end of the screen is connected to the back end of the frame, a removable trough positioned near the back ends of the frame and screen for catching large separated material that rolls of the screen when the screen is slanted at an angle relative to the frame, and a motor attached near a bottom surface of the screen which functions to vibrate the screen to aid in particle separation.

A tow bar having upper and lower surfaces may be attached to the front end of the frame and a support bar positioned between the ground and the tow bar may be attached to the top surface of the tow bar.

In accordance with a further aspect of the invention, a vertical bar having an adjustable height may be attached to the top surface of the tow bar and connected to the back end of the adjustable screen so that the screen can be positioned at various angles with respect to the underlying frame. The adjustable height of front end of the screen aids in directing materials into the removable trough that do not pass through the screen. In accordance with another aspect of the invention, a crank handle may be attached to the vertical bar for adjusting the height of the vertical bar.

One or more vertical support bars may be positioned proximate to the bottom surface of the screen extending from the front of the screen to the back of the screen. In addition, at least one horizontal cross bar member may be positioned proximate the bottom surface of the screen extending across the width of the screen.

In accordance with another aspect of the invention, a pair of mounting brackets may be used for mounting each horizontal cross bar member. The mounting brackets contain an opening through which the horizontal cross bar member can be inserted and held. In a further aspect of the invention, the mounting brackets include an outer layer, a middle layer, and an inner layer which lies adjacent the opening in the mounting bracket. The middle layer of the mounting bracket may be comprised of an isolation material such as an insulator.

In one exemplary embodiment of the invention, the horizontal cross bar members have square shaped cross-sections and the motor is secured to the bottom surface of one of the horizontal cross bar members. A mounting plat may be used to secure the motor to the bottom surface of the horizontal cross bar member.

In another exemplary embodiment of the invention, the adjustable screen includes a lip member extending from the top surface of the screen that is positioned about the circumference of the screen except for the back end of the screen that is positioned near the removable trough. The lack of a lip member on the back end of the outer circumference of the screen allows material that does not pass through the screen to easily fall into the removable trough when the front end of the screen is elevated.

In accordance with yet another aspect of the invention, a platform may be attached to the back end of the frame for supporting and retaining the removable trough. In addition, the removable trough may include a lip member on one of its upper edges to aid in directing debris into the removable trough, and handles may be placed on opposite sides of the removable trough for easily removing the trough when it is full of debris that must be discarded.

BRIEF DESCRIPTION OF THE DRAWINGS

The subject invention will hereinafter be described in conjunction with the appended drawing figures, wherein like numerals demote like elements.

DETAILED DESCRIPTION

Figure 1:
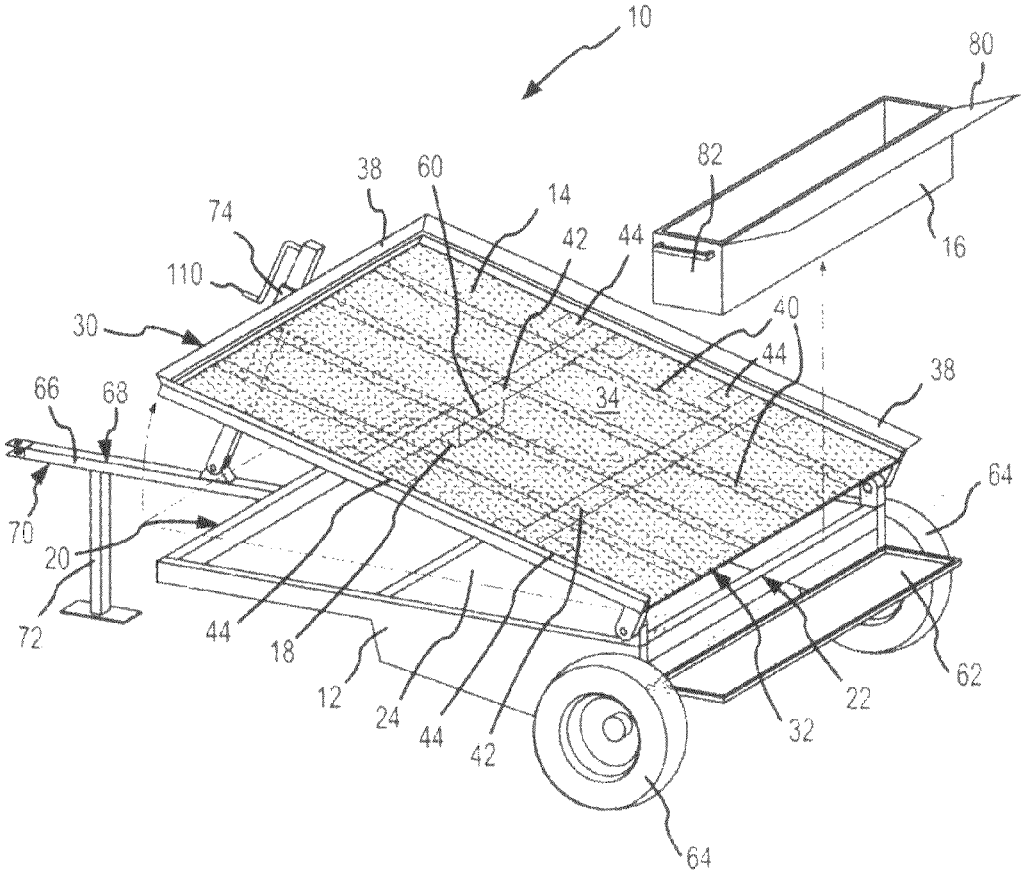
FIG. 1 is a perspective view of the separation apparatus of the present invention showing one end of the adjustable screen in an elevated position and the removable trough removed from the apparatus.

The present invention generally provides a method and apparatus for separating fine particulate matter from other materials. The separation apparatus 10 of the present invention includes a frame 12, an adjustable screen 14 positioned over frame 12 which is adjustable in height relative to frame 12 on one of its ends, a removable trough 16 positioned near one end of frame 12 and screen 14, and a motor 18 attached near a bottom surface of screen 14 for vibrating screen 14.

Frame 12 includes a first or front end 20 and second or back end 22 and may comprise a variety of designs and configurations as long as frame 12 defines a large opening 24 through which fine particulate matter can travel after passing through screen 14. Screen 14 includes a first or front end 30, a second or back end 32, a top surface 34 and a bottom surface 36. Screen 14 further comprises a lip member 38 which extends from top surface 34 of screen 14 and is positioned around a circumference of screen 14 except for second or back end 22 of screen 14. Lip member 38 functions to aid in retaining matter to be separated on top of screen 14 until it either passes through screen 14 or rolls down screen 14 and into removable trough 16.

Screen 14 may also comprise one or more vertical support bars 40 positioned proximate to bottom surface 36 of screen 14 which traverse screen 14 from first or front end 30 of screen 14 to second or back end 32 of screen 14. Screen 14 also includes at least one horizontal cross bar member 42 positioned proximate to bottom surface 36 of screen 14 which extends across the width of screen 14. Each horizontal cross bar member 42 is mounted to bottom surface 36 of screen 14 with a pair of mounting brackets 44 which are positioned at opposite ends of horizontal cross bar member 42 and opposite sides of frame 14.

Figure 6:
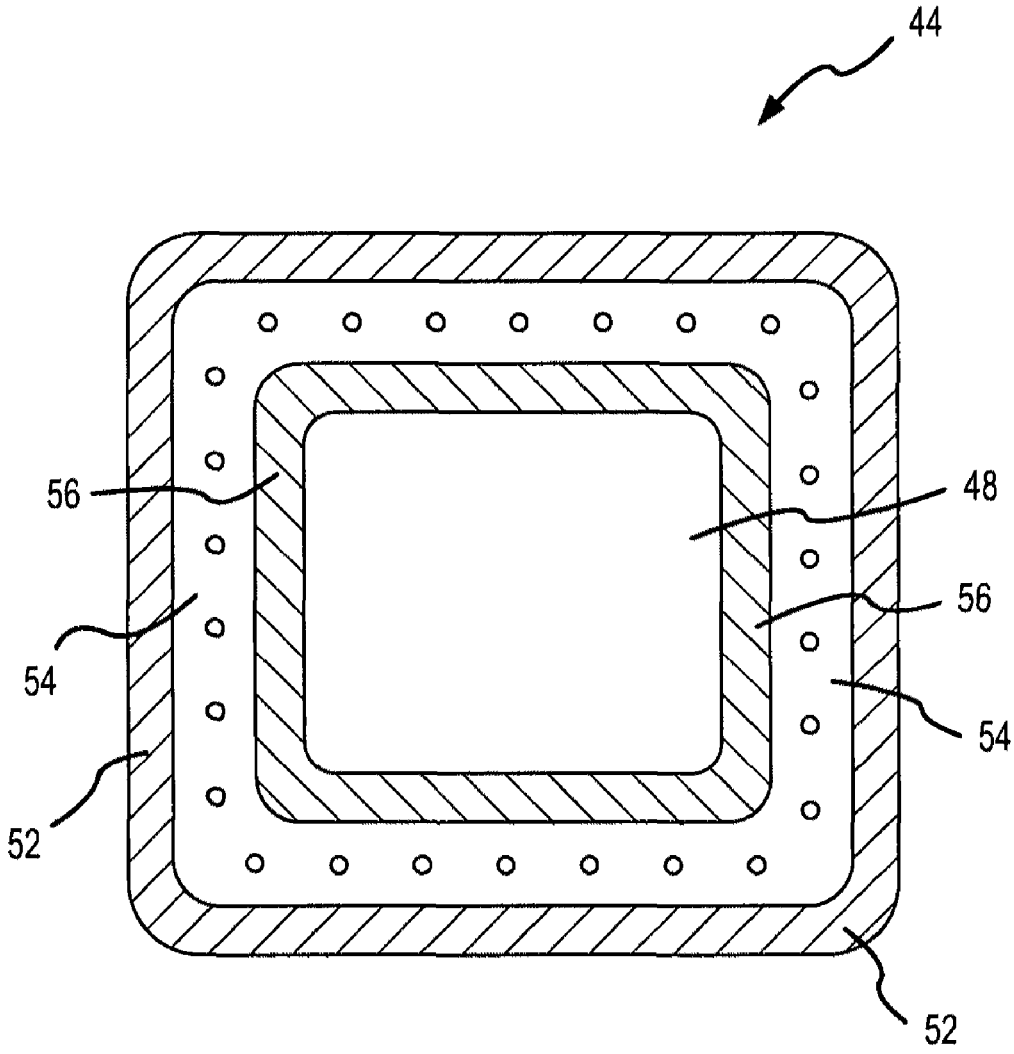
FIG. 6 is a cross-sectional view of a mounting bracket used for mounting a horizontal cross bar member to the bottom of the screen of the separation apparatus of the present invention.

Mounting brackets 44 may comprise numerous configurations and designs but have an opening 48 contained therethrough (See FIG. 6) for inserting and retaining opposite ends of horizontal cross bar member 42. FIG. 6 shows a cross sectional view of mounting bracket 44. Mounting bracket 44 includes an outer layer 52, a middle layer 54, and an inner layer 56 which lies adjacent to opening 48. Outer and inner layers 52 and 56 may be comprised of metal such as steel or aluminum, for example, but may be comprised of any rigid, durable material. Middle layer 54 is comprised of an isolation material, such as an insulator, which functions to create a free-floating effect that isolates the vibrational force to screen 14. Mounting brackets 44 may be welded to the sides of screen 14.

It will also be appreciated by those skilled in the art that screen 14 may further comprise an outer screen frame to which mounting brackets 44 and lip member 38 may be secured or attached. Motor 18 is preferably mounted to horizontal cross bar member 42 and a mounting plate 60 may be used to mount motor 18 to horizontal cross bar member 42.

Separation apparatus 10 further comprises a platform 62 attached to the second or back end 22 of frame 20 to support and retain removable trough 16 while separation apparatus 10 is in use. Separation apparatus 10 may also include one or more wheels 64 attached to frame 12 for facilitating the movement of separation apparatus 10 from one location to another.

A tow bar 66 having an upper surface 68 and a lower surface 70 may be attached to first or front end 20 of frame 12. In addition, a support bar 72 may be attached to lower surface 70 of tow bar 66 to stabilize separation apparatus 10 above the ground during use. Support bar 72 may be removable or foldable so that separation apparatus 10 can be easily moved or towed when not in use. A vertical bar member 74 of adjustable height is attached to upper surface 68 of tow bar 66 and to bottom surface 36 of screen member 14 and functions to adjust the height of first of front end 30 of screen 14 relative to frame 12 and the ground. Second or back ends 22 and 32 of frame 12 and screen 16, respectively, are preferably rotatably connected to one another so that screen 14 can be adjusted at various angles with respect frame 12 and the ground.

Removable trough 16 comprises a generally rectangular shape and includes a lip member 80 along its top length to aid in directing debris and bulk material that does not pass through screen 14 into removable trough 16. Removable trough 16 also includes handles 82 located at its opposite ends for easily lifting and removing removable trough 16 from platform 62 to discard debris and bulk material.

Figure 2:
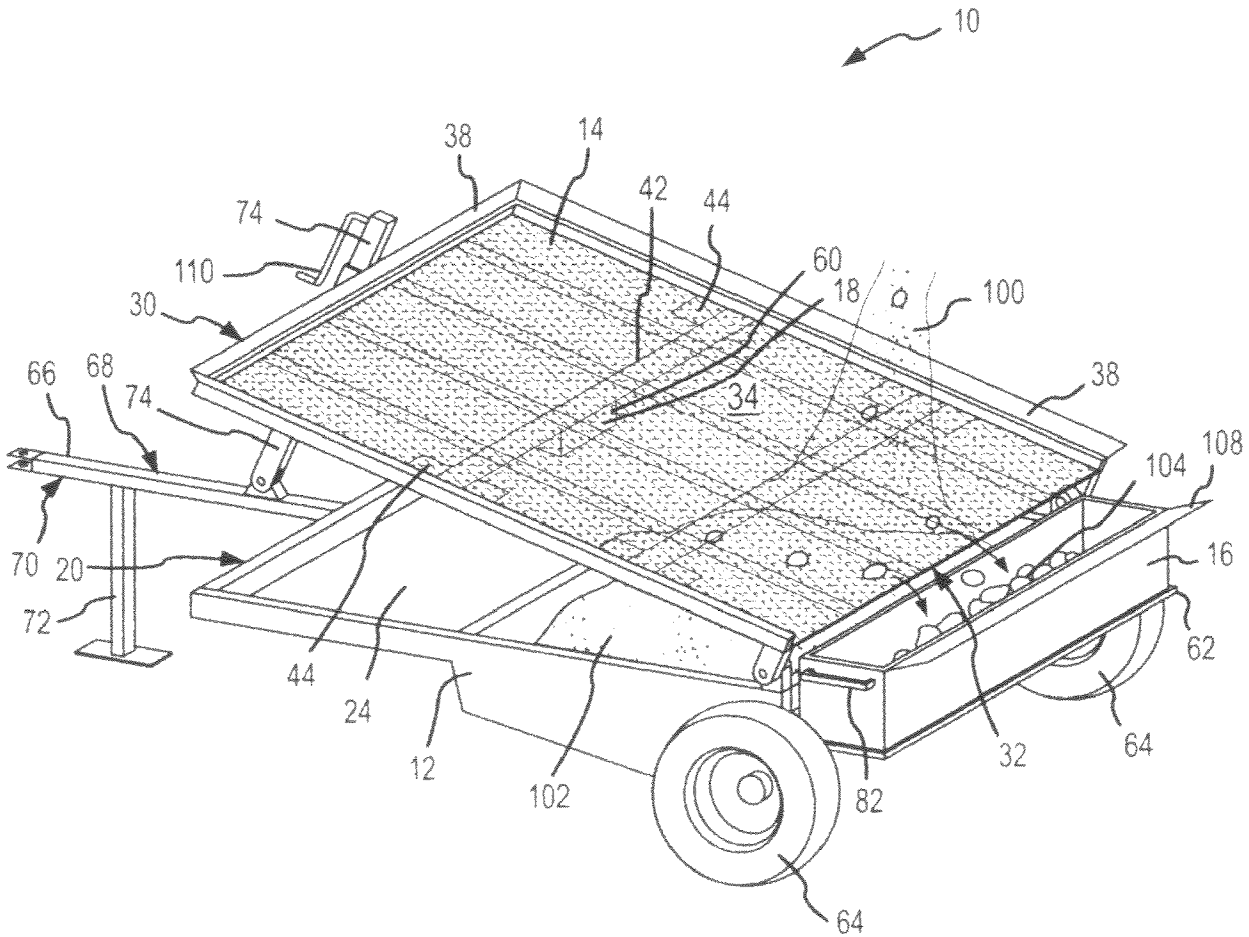
FIG. 2 is a perspective view of the separation apparatus of the present invention shown in use to perform the function of separating debris and bulk materials from fine particulate matter.

Turning now to FIG. 2, a perspective view of the separation apparatus of the present invention shown in use to perform the function of separating debris and bulk materials from fine particulate matter is shown. Prior to use, first or front end 30 of screen 14 of separation apparatus 10 is elevated so that screen 14 forms an angle relative to frame 12 and the ground. A mixture 100 of fine particulate matter, such as sand contained in golf course sand traps, for example, and bulk material and debris, such as rocks, leaves, twigs, and branches, for example, is poured onto top surface 34 of screen 14. Motor 18 is turned on to vibrate screen 14 which facilitates the separation of fine particulate matter 102 from debris and bulk material 104 by assisting passage of the fine particulate matter 102 through screen 14. The fine particulate matter 102 that passes through screen 14 also passes through opening 24 in frame 12 and is returned to its original location.

Figure 3:
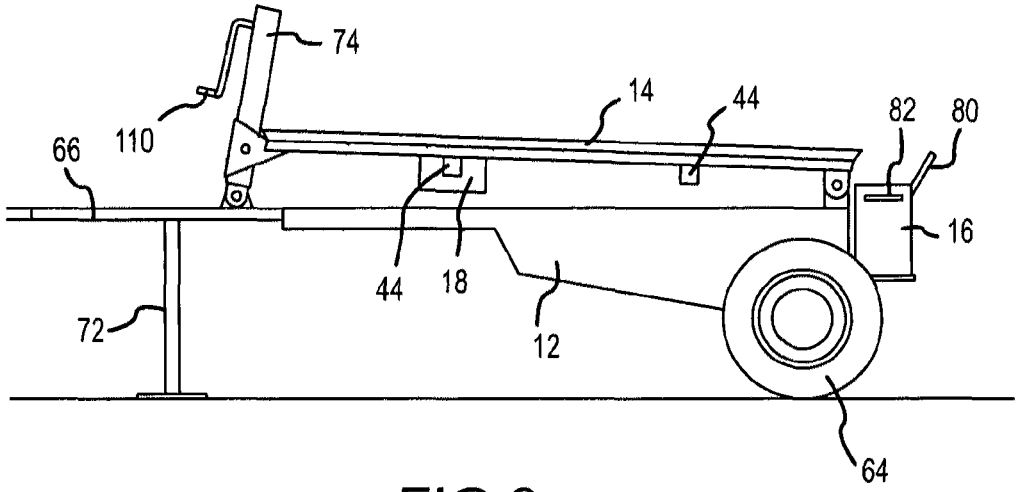
FIG. 3 is a side elevational view of the separation apparatus of the present invention shown in a stored position.
Figure 4:
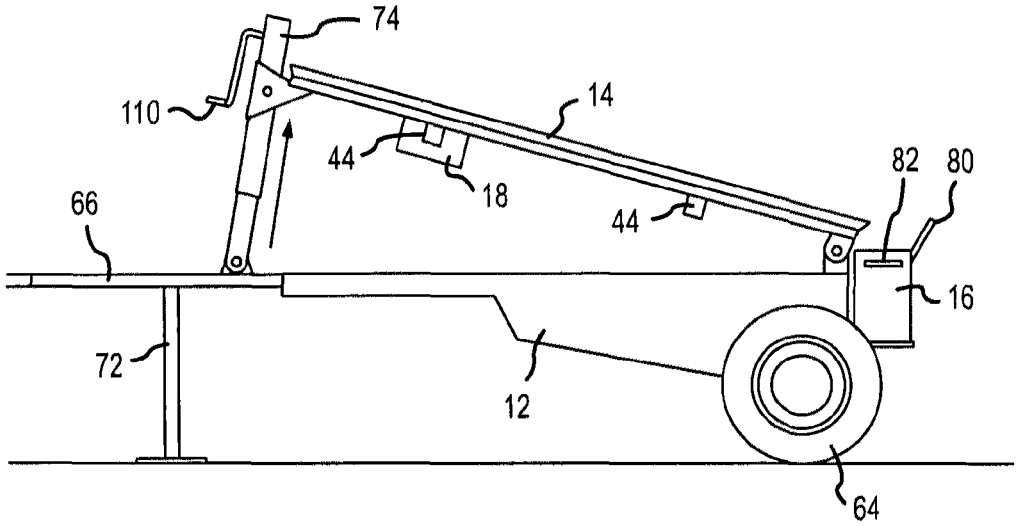
FIG. 4 is a side elevational view of the separation apparatus of the present invention shown positioned for use.
Figure 5:
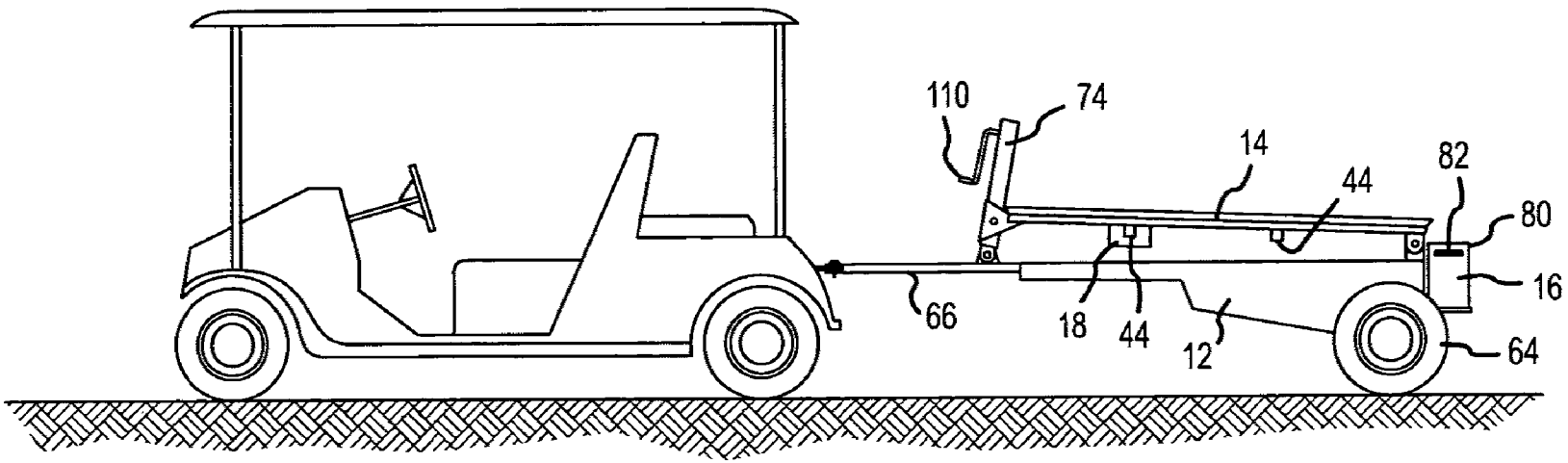
FIG. 5 is a side elevational view of the separation apparatus of the present invention being towed by a golf cart to move the separation apparatus to another location for use.

After separation apparatus 10 has performed its function, first or front end 30 of screen 14 is lowered to the height of second or back end 32 of screen 14 to move separation apparatus 10 in a stored, or nonuse, position as shown in FIG. 3. Separation apparatus 10 can then be easily moved or transported by attaching tow bar 66 to a vehicle or golf cart, for example, when separation apparatus 10 is being used to separate sand in golf sand traps from other materials, as shown in FIG. 5. Once separation apparatus 10 is moved to a new location for use, the height of vertical bar member 74 is increased by using crank handle 110, for example, and first or front end 30 of frame 14 is raised relative to frame 12 and the ground as shown in FIG. 4. As a result, separation apparatus 10 is once again ready for use.

Figure 7:
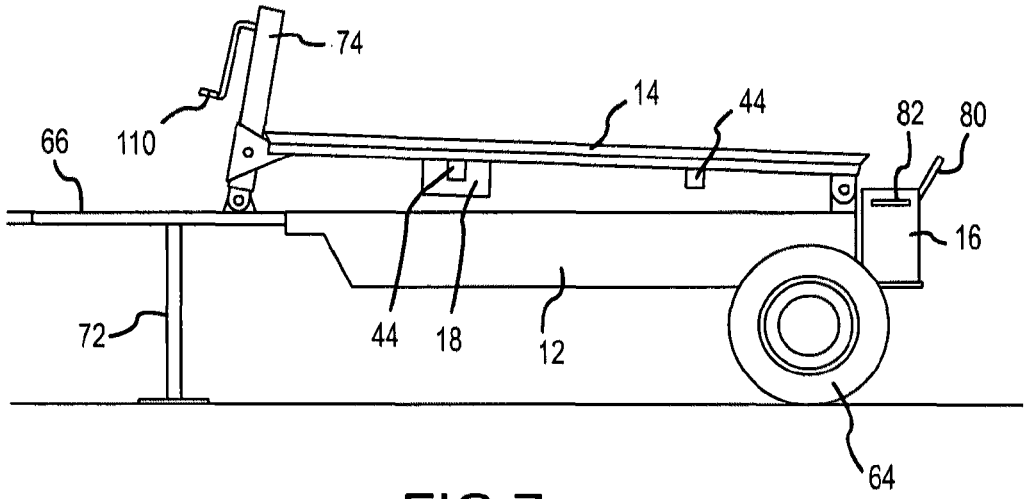
FIG. 7 is a side elevational view of another embodiment of the separation apparatus of the present invention shown in a stored position.
Figure 8:
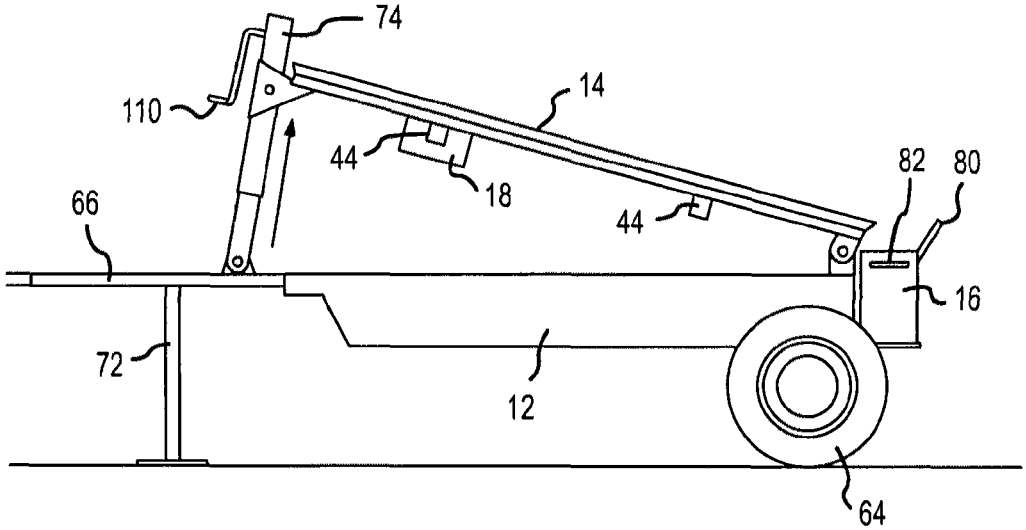
FIG. 8 is a side elevational view of the embodiment of the separation apparatus of the present invention depicted in FIG. 7 shown positioned for use.

As previously stated, frame 12 may comprise various designs and configurations. Another exemplary embodiment of frame 12 of separation apparatus is shown in FIGS. 7 and 8.

Although the invention has been described herein in conjunction with the appended drawings, those skilled in the art will appreciate that the scope of the invention is not so limited. Modifications in the selection, design, and arrangement of the various components and steps discussed herein may be made without departing from the scope of the invention.

The invention claimed is:

1. An apparatus for separating a fine particulate material from other matter comprising:

a frame having a front end and a back end;

an adjustable screen having a front end, a back end, a top surface and a bottom surface, wherein the adjustable screen is positioned over a top of the frame and the back end of the adjustable screen is connected to the back end of the frame;

a tow bar having an upper surface and a lower surface attached to the front end of the frame; and a vertical bar member of adjustable height attached to the upper surface of the tow bar and the bottom surface of the adjustable screen member.

2. The apparatus of claim 1 further comprising a platform connected to the back end of the frame.

3. The apparatus of claim 2 further comprising a removable trough positioned on the platform wherein the removable trough is not connected to the frame.

4. The apparatus of claim 1 further comprising a motor attached to the bottom surface of the adjustable screen.

5. The apparatus of claim 1 further comprising at least one wheel attached to the frame for facilitating movement of the apparatus.

6. The apparatus of claim 1 further comprising a lip member positioned about a circumference of an upper surface of the screen except for the back end of the screen.

7. The apparatus of claim 1 wherein the screen further comprises a plurality of vertical support bars positioned proximate to the bottom surface of the screen and extending from the front end to the back end of the screen.

8. The apparatus of claim 3 wherein the removable trough includes a lip member extending from an upper edge of the removable trough for directing debris into the removable trough.

9. The apparatus of claim 3 wherein the removable trough includes a pair of handles positioned at opposite ends of the removable trough.

* * * * *